US011008135B2

(12) United States Patent
Spadavecchia et al.

(10) Patent No.: US 11,008,135 B2
(45) Date of Patent: May 18, 2021

(54) PALLET WITH ERGONOMIC HAND HOLE

(71) Applicant: Daniel Kelly, Medford, NJ (US)

(72) Inventors: John A. Spadavecchia, Red House, VA (US); Gerald Koefelda, Lake Bluff, IL (US)

(73) Assignee: Daniel Kelly, Medford, NJ (US)

( * ) Notice: Subject to any disclaimer, the term of this patent is extended or adjusted under 35 U.S.C. 154(b) by 0 days.

(21) Appl. No.: 16/284,540

(22) Filed: Feb. 25, 2019

(65) Prior Publication Data

US 2019/0185208 A1 Jun. 20, 2019

Related U.S. Application Data

(63) Continuation of application No. 15/590,092, filed on May 9, 2017, now Pat. No. 10,214,318.

(60) Provisional application No. 62/333,892, filed on May 10, 2016.

(51) Int. Cl.
*B65D 19/38* (2006.01)
*B65D 19/00* (2006.01)

(52) U.S. Cl.
CPC ..... *B65D 19/38* (2013.01); *B65D 19/00* (2013.01); *B65D 19/004* (2013.01); *B65D 19/0012* (2013.01); *B65D 19/0014* (2013.01); *B65D 2519/00034* (2013.01); *B65D 2519/00069* (2013.01); *B65D 2519/00268* (2013.01); *B65D 2519/00288* (2013.01); *B65D 2519/00318* (2013.01); *B65D 2519/00338* (2013.01); *B65D 2519/00815* (2013.01)

(58) Field of Classification Search
CPC ..... B65D 19/00; B65D 19/38; B65D 19/44; B65D 21/00; B65D 21/02
USPC ..... 108/51.11, 57.25, 53.3, 56.3
See application file for complete search history.

(56) References Cited

U.S. PATENT DOCUMENTS 3,269,336 A * 8/1966 Naylor ..... B65D 19/0012 108/55.1
4,051,787 A * 10/1977 Nishitani ..... B65D 19/0012 108/55.3
4,060,037 A * 11/1977 Gustafsson ..... B65D 19/0024 108/55.1
5,042,396 A * 8/1991 Shuert ..... B65D 19/0012 108/57.25
5,868,080 A * 2/1999 Wyler ..... B65D 19/0022 108/57.25
6,530,476 B1 * 3/2003 Overholt ..... B65D 71/0096 108/55.3
6,928,933 B2 * 8/2005 Grau ..... B41F 23/0443 108/57.25
7,819,068 B2 * 10/2010 Apps ..... B65D 19/004 108/53.1
D647,685 S * 10/2011 Atkins ..... D34/38
8,601,954 B1 * 12/2013 Steinbok ..... A47B 3/06 108/11

(Continued)

*Primary Examiner* — Jose V Chen
(74) *Attorney, Agent, or Firm* — Massina Pat. & TM Law PLLC

(57) ABSTRACT

A pallet including a pallet deck supported along a base plane. The pallet deck defines a load support surface within a given perimeter. The pallet deck includes at least one hand hole extending therethrough. The at least one hand hole is defined by a circumferential wall extending below the load support surface. The circumferential wall has a lower edge with a curved surface defined along at least a portion of the lower edge of the circumferential wall.

14 Claims, 11 Drawing Sheets

(56) References Cited

U.S. PATENT DOCUMENTS

| | | | | |
|---|---|---|---|---|
| 10,214,318 | B2 * | 2/2019 | Spadavecchia | B65D 19/38 |
| 2003/0089285 | A1 * | 5/2003 | Carson | B65D 19/0016 108/57.28 |
| 2006/0201402 | A1 * | 9/2006 | Moore, Jr. | B65D 19/0012 108/57.25 |
| 2008/0011205 | A1 * | 1/2008 | Haaf | B65D 19/0036 108/53.3 |
| 2008/0308015 | A1 * | 12/2008 | Apps | B65D 19/004 108/53.3 |
| 2009/0183655 | A1 * | 7/2009 | Ogburn | B65D 19/0016 108/57.25 |
| 2011/0120353 | A1 * | 5/2011 | Jensen | B65D 19/0016 108/57.25 |
| 2012/0111238 | A1 * | 5/2012 | Frankenberg | B62B 5/0093 108/57.25 |
| 2014/0158025 | A1 * | 6/2014 | Apps | B29C 45/0003 108/57.25 |
| 2015/0135999 | A1 * | 5/2015 | Takyar | B65D 19/0018 108/53.3 |

* cited by examiner

PALLET WITH ERGONOMIC HAND HOLE

This application is a continuation of U.S. patent application Ser. No. 15/590,092, filed on May 9, 2017, which claims the benefit of U.S. Provisional Patent Application No. 62/333,892, filed on May 10, 2016, each of which is incorporated herein by reference.

FIELD OF THE INVENTION

This invention relates to pallets. More particularly, the invention relates to pallets having a top deck with a concave load support surface.

BACKGROUND OF THE INVENTION

Flowering is a term used to describe one type of instability of a pallet load (unit load). As illustrated in FIG. 1, flowering is a condition where columns of boxes 20 spread apart or lean away from each other as a pallet 10 is lifted or moved. This condition is a common occurrence in industry.

Flowering is most readily seen when a load, column stacked boxes for example, that had been loaded on a pallet deck 12 in a stable manner with the columns immediately adjacent to each other is lifted by a fork lift or pallet hand jack positioned within the openings 16 between the legs 14 of the pallet 10. Because the areas where the forks make contact with the pallet 10 are inset from the edges of the pallet deck 12, a portion of the load acts upon the portions of the pallet deck 12 that are cantilevered out beyond the support. The effect is typically to bend the outside of the edges downward and, often, to bow or raise the center of the pallet. The originally planar top surface 13 becomes convex.

As the top surface 13 of the pallet deck 12 becomes convex, the bottom box of each column stays in contact with the surface. As a result, the remaining boxes in the column flare or flower outward. As the columns continue to flower outward, they move farther away from the surrounding columns and the load becomes less and less stable, possibly falling over.

The same effect may be seen as a pallet moves on a conveyor. Depending on the pitch of the rollers, the distance between adjacent rollers, or the severity of transition points between conveyors, loaded pallets may bow in a manner similar to being lifted by a fork truck.

Flowering is typically counteracted by wrapping the load. In some instances, just the top portion of the load may be wrapped using strapping or stretch wrap. More often, the entire load is secured with strapping or wrapped with stretch wrap.

Strapping or wrapping of the unit loads adds cost. Slower line throughputs, for strapping/wrapping or unstrapping/unwrapping, additional labor, again for strapping/wrapping and unstrapping/unwrapping, additional material, additional equipment, additional floor space, the strapping/wrapping materials, and disposal of the strapping/wrapping materials may all be components of these increased costs. While strapping/wrapping can counteract some of the instability, it cannot stop instability of the load moving on a conveyor or moving through production processes prior to the strapping/wrapping point. Further, if the unit loads are work-in-process materials or are to be broken down for customer specific orders, the pallets may have to be strapped/wrapped and unstrapped/unwrapped multiple times before eventually being shipped.

As another potential problem, a unit load traveling through a packing line or supply chain it is subject to many different forces acting upon it, including vibration. A unit load traveling down a conveyor line or being moved by fork lift across an imperfect floor are common examples of this issue. As the load is vibrated, the columns of boxes 20 may separate or move toward the edge of the pallet deck 12. Both situations reduce the overall stability of the unit load.

Additionally, a unit load will experience centrifugal forces and lateral forces as it moves through production lines and supply chains. These forces will act to destabilize the load. These forces, for example, may result from curves and stopping points in a conveyor line; turns or stops made by a fork lift, or turns and stops made by a truck carrying the unit load.

A simple definition of centrifugal force is "a force that causes an object moving in a circular path to move out and away from the center of its path." Lateral force is defined as a force whose main components are acting in a generally horizontal direction. The effects of the centrifugal and lateral forces are to move the center of gravity of a column of boxes on a pallet toward the outside of the pallet. For the column of boxes to remain stable, the center of gravity must remain within the base of support—the bottom of the lowest box. If an object is tilted it will fall over if a vertical line from its center of gravity falls outside its base.

SUMMARY OF THE INVENTION

In at least one embodiment, the present invention provides a pallet including a pallet deck supported by a plurality of legs, each leg defining a bottom surface with the bottom surface of each of the legs extending in a base plane. The pallet deck defines a load support surface within a given perimeter. The load support surface includes at least a tapered portion which tapers in increasing height relative to the base plane from a tapered portion inner perimeter to a tapered portion outer perimeter such that the load support surface has a concave configuration.

In at least one embodiment, the load support surface includes a central planar portion within the tapered portion inner perimeter, the central planar portion extending substantially parallel to the base plane.

In at least one embodiment, the load support surface within the tapered portion is defined by a stepped pallet deck surface.

In at least one embodiment, the load support surface within the tapered portion is defined by an inclined pallet deck surface.

In at least one embodiment, the load support surface within the tapered portion is defined by a pallet deck surface which increases in thickness moving from the tapered portion inner perimeter to the tapered portion outer perimeter.

In at least one embodiment, the load support surface within the tapered portion is defined by a plurality of annular ribs with the annular ribs increasing in height from an inner most annular rib proximate the tapered portion inner perimeter to an outer most annular rib proximate the tapered portion outer perimeter.

In at least one embodiment, the load support surface within the tapered portion is defined by a plurality of radial ribs with each radial rib increasing in height from an inner most portion proximate the tapered portion inner perimeter to an outer most portion proximate the tapered portion outer perimeter.

In at least one embodiment, the present invention provides a pallet including a pallet deck supported along a base plane. The pallet deck defines a load support surface within a given perimeter. The pallet deck includes at least one hand hole extending therethrough. The at least one hand hole is defined by a circumferential wall extending below the load support surface. The circumferential wall has a lower edge with a curved surface defined along at least a portion of the lower edge of the circumferential wall.

BRIEF DESCRIPTION OF THE DRAWINGS

The accompanying drawings, which are incorporated herein and constitute part of this specification, illustrate the presently preferred embodiments of the invention, and, together with the general description given above and the detailed description given below, serve to explain the features of the invention. In the drawings.

DETAILED DESCRIPTION OF THE INVENTION

Figure 1:
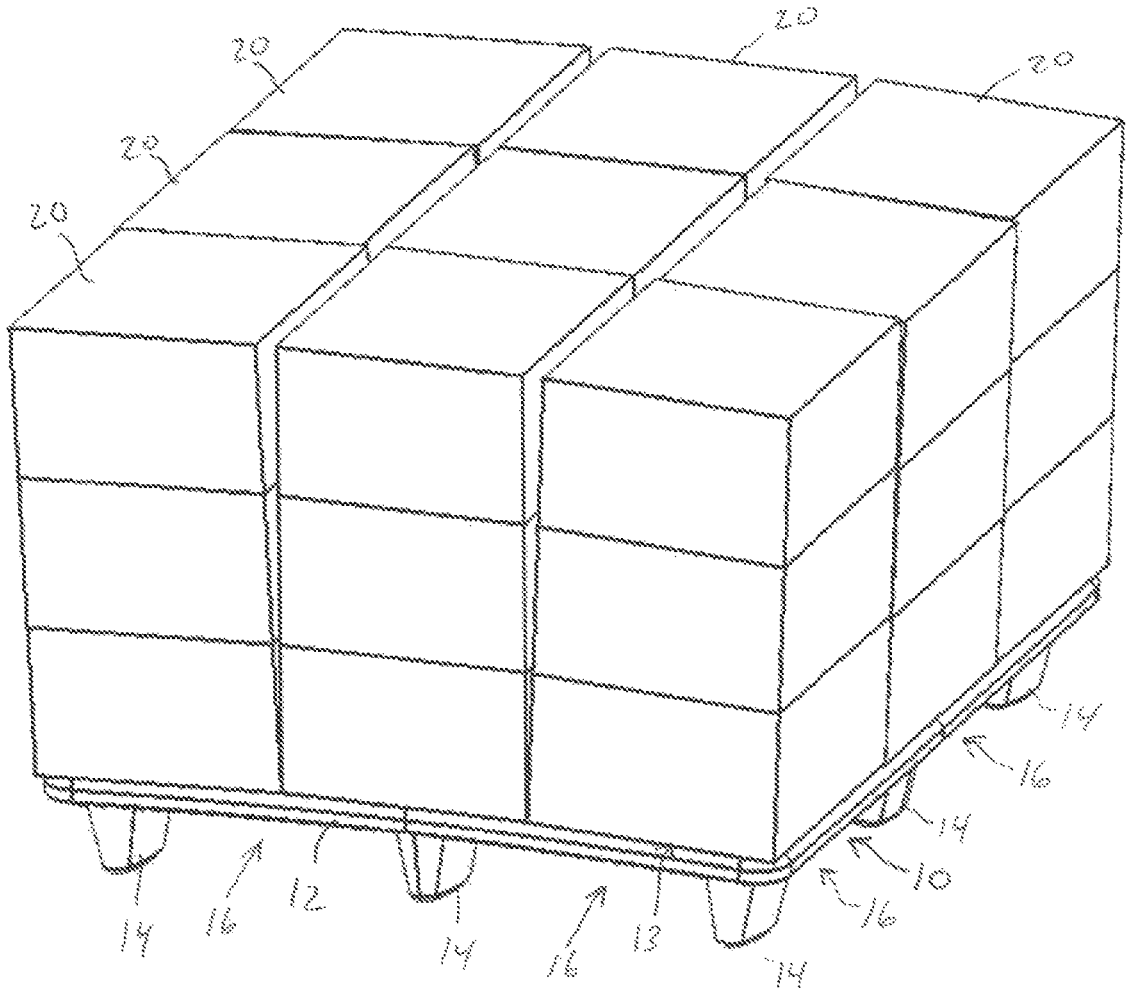
Fig. 1 (Prior Art)
FIG. 1 is a perspective view of a prior art pallet with a load positioned thereon and illustrating a flowering condition.

In the drawings, like numerals indicate like elements throughout. Certain terminology is used herein for convenience only and is not to be taken as a limitation on the present invention. The following describes preferred embodiments of the present invention. However, it should be understood, based on this disclosure, that the invention is not limited by the preferred embodiments described herein.

Figure 2:
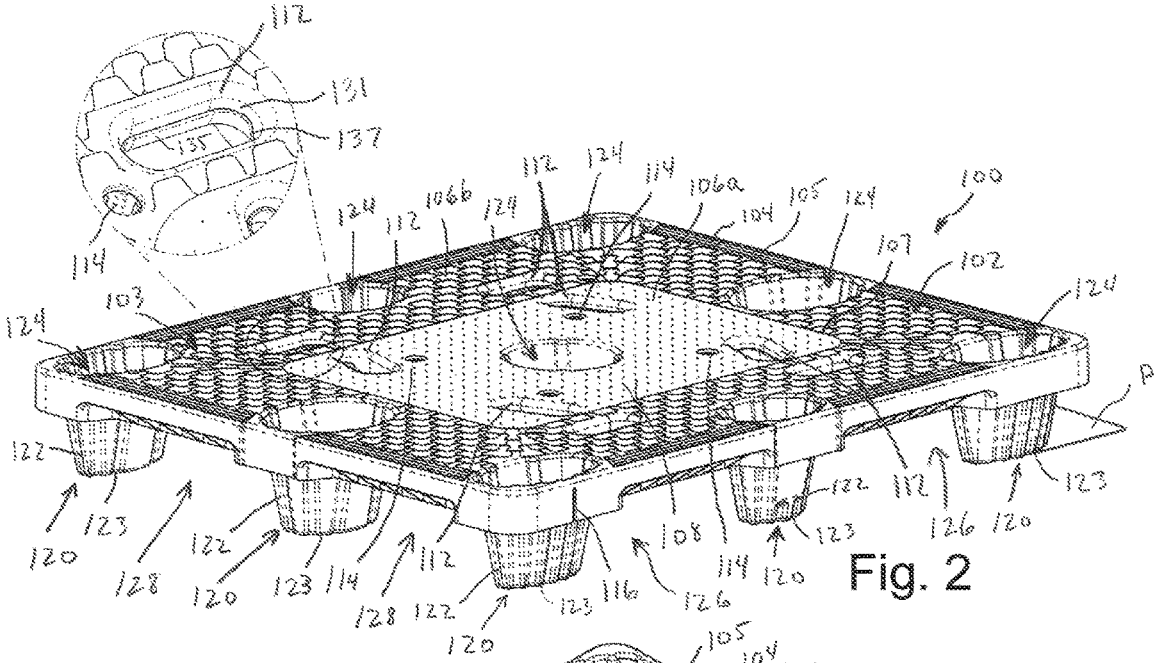
FIG. 2 is a perspective view of a pallet in accordance with an embodiment of the invention.
Figure 3:
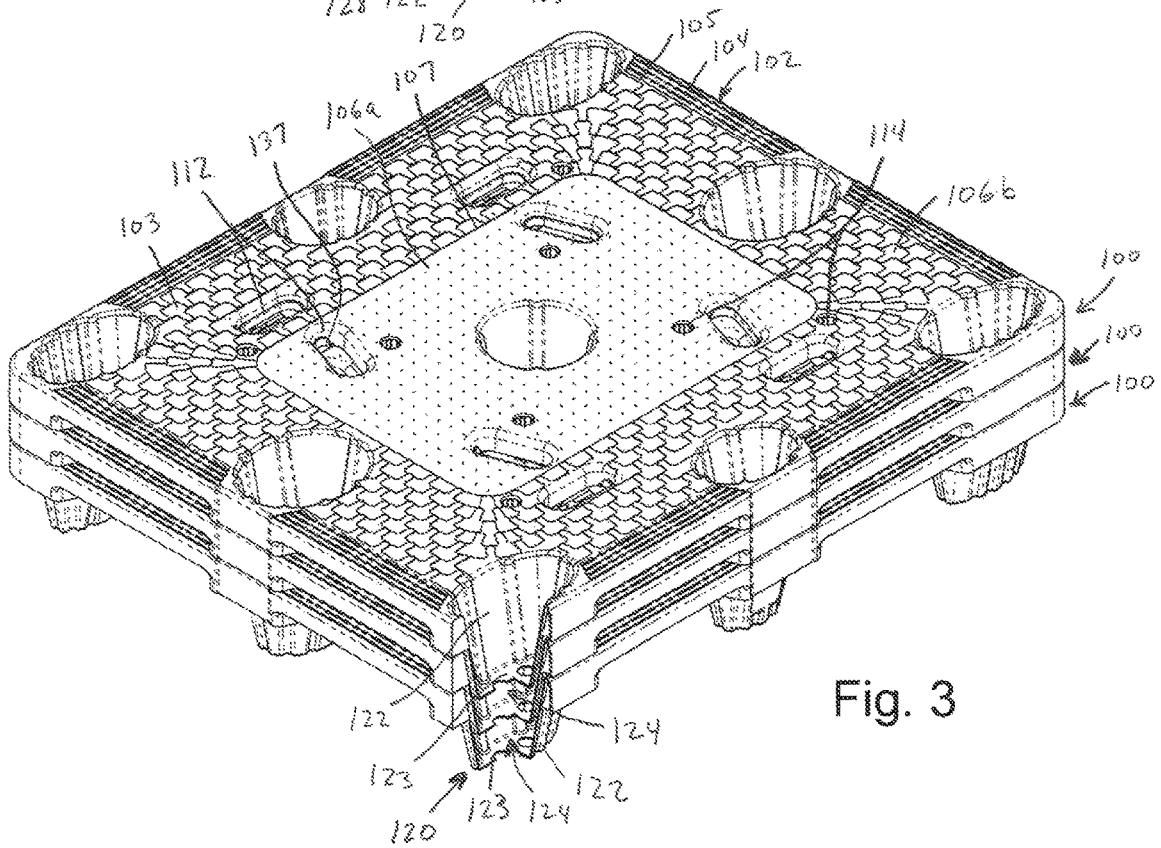
FIG. 3 is a perspective view illustrating several of the pallets of FIG. 2 in a stacked configuration.
Figure 4:
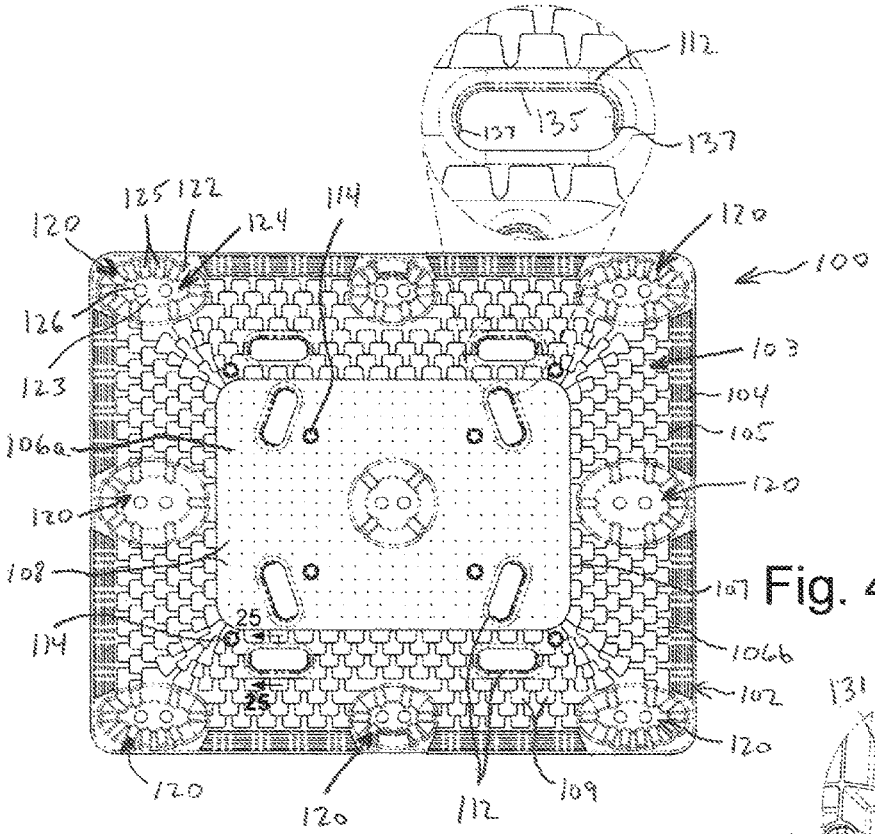
FIG. 4 is a top plan view of the pallet of FIG. 2.

Referring to FIGS. 2-9, a pallet 100 in accordance with a first embodiment of the invention will be described. The pallet 100 generally comprises a pallet deck 102 supported by a plurality of legs 120. The legs 120 are spaced apart to define longitudinal tine openings 126 and lateral tine openings 128. In the illustrated embodiment, each of the legs 120 includes a perimeter wall 122 and a bottom surface 123 about a hollow area 124. Such configuration allows the pallets 110 to be stacked one upon the other with the legs 120 nesting within one another as illustrated in FIG. 3. As illustrated in FIG. 4, the perimeter wall 122 may include reinforcing ribs 125 formed therein and the bottom surface 123 may include through holes 126 to allow for drainage. While the pallet 100 of the present embodiment includes nestable legs 120, the invention is not limited to such and the legs may have other configurations. The bottom surface 123 of each of the legs 120 preferably extend along a common base plane P such that the pallet deck 102 is equally supported by each of the legs 120.

Figure 5:
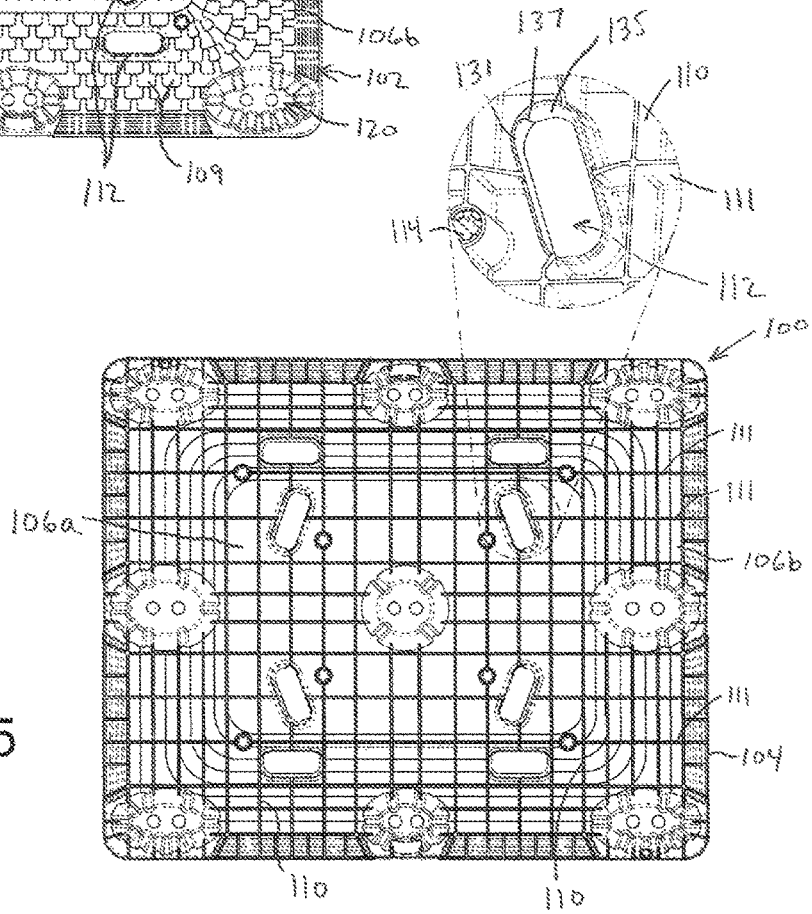
FIG. 5 is a bottom plan view of the pallet of FIG. 2.
Figure 6:
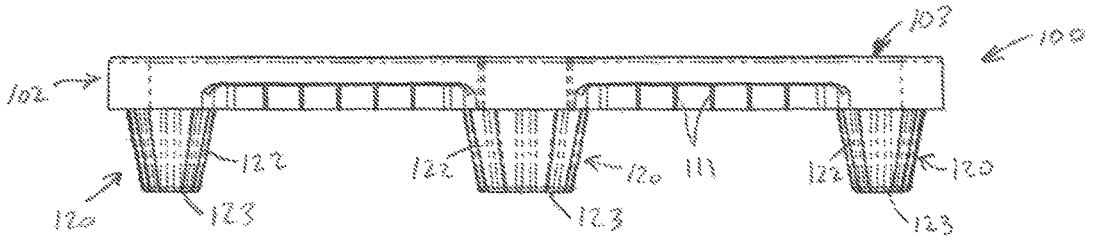
FIG. 6 is a side elevation view of the pallet of FIG. 2.
Figure 7:
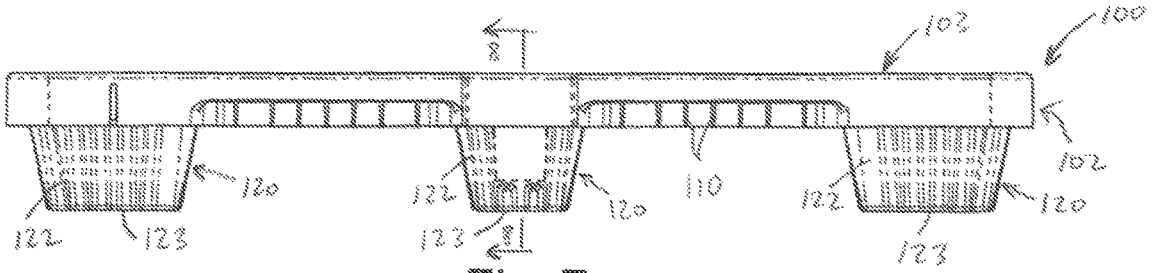
FIG. 7 is a front elevation view of the pallet of FIG. 2.

The pallet deck 102 includes a deck surface 103 extending within perimeter 104. While the illustrated embodiment has a rectangular perimeter 104, the invention is not limited to such and the pallet deck 102 may have various configurations. The deck surface 103 is supported by a plurality of lateral ribs 110 and longitudinal ribs 111 as illustrated in FIG. 5. While the pallet deck 102 of the present invention includes a rib structure, the invention is not limited to such. The deck 102 may include, for example, a solid structure, a beam structure or any other desired structure. As illustrated in FIGS. 2-5 and 25, the pallet deck 102 of the present embodiment includes a plurality of ergonomic hand holes 112 extending therethrough which facilitate manual manipulation of the pallet 100. Each hand hole 112 includes a circumferential wall 131 extending from the deck surface 103. The lateral ribs 110 and longitudinal ribs 111 connect with the wall 131 and provide support thereto. Along at least a portion of the wall 131, the lower edge thereof includes a curved surface 133 defined by a return wall 135. The curved surface 133 and return wall 135 provide a smooth holding surface such that a flat edge of the wall 131 does not dig into a user's hand as they lift the pallet 100 utilizing one of the hand holes 112. In the embodiment illustrated in FIGS. 4 and 5, the curved surface 133 of each hand hole 112 extends over an outer portion of the wall 131, i.e. toward the perimeter of the pallet deck 102. In the illustrated embodiment, the curved surface extends, for example, along more than 50% of the wall 131 and ends at opposed ends 137 of the return wall 135 (see FIG. 4). The remainder of the wall 131 has a simple flat edge. It is understood that the curved edge 133 may extend over more or less than the illustrated portion of the wall 131, including completely around the entire circumferential wall 131.

Additionally, the illustrated pallet deck 102 includes a plurality of grommet sockets 114 configured to receive and support grommets which may be utilized in securing various loads on the deck surface 103. Referring to FIG. 2, the pallet deck 102 may further include slots 116 which may be utilized as stretch wrap anchors. It is noted that while the advantages of the present invention are most readily observed with an unwrapped unit load, the same advantages are still applied to a secured load.

Figure 8:
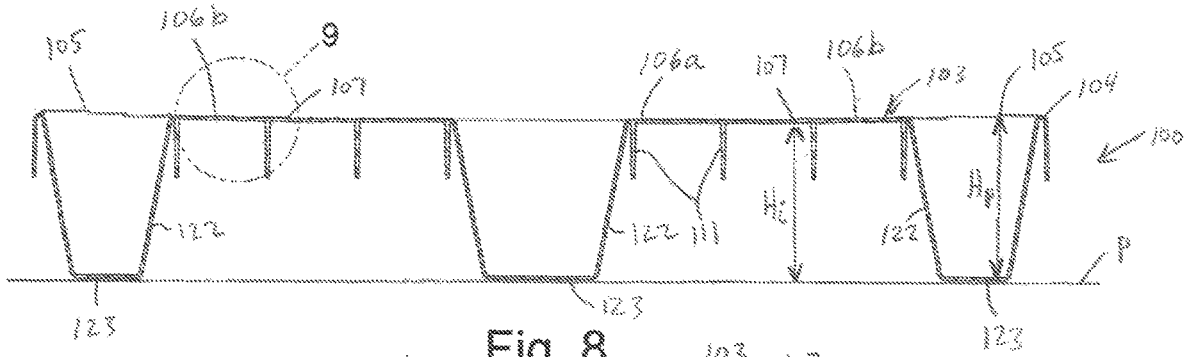
FIG. 8 is a cross-sectional view of along the line 8-8 in FIG. 7.

The deck surface 103 includes a central planar portion **106*a*, substantially parallel to the base plane P, and a perimeter tapered portion 106*b*. In the illustrated embodiment, the central planar portion 106*a* includes a series of bumps 108 to define an anti-slip textured surface. Referring to FIG. 8, the tapered portion 106***b* tapers from a height Hp, measured relative to the base plane P, at its outer perimeter 105 to a lower height Hi, again measured relative to the base plane P, at its inner perimeter 107. The height Hi at the inner perimeter 107 is preferably equal to the height of the planar portion 106*a* relative to the base plane P. The outer perimeter 105 may be defined inward of the deck perimeter 104, as illustrated, or may extend to the deck perimeter 104. In the illustrated embodiment, the height Hp at the outer perimeter 105 is equal to the height at the perimeter 104 such that a planar surface generally parallel to the base plane P is defined between the outer perimeter 105 and the deck perimeter 104. With the tapered configuration of the tapered portion 106*b*, the deck surface 103 defines a concave surface. It is understood that the area of the central planar portion 106*a* may be selected as desired, and further, the central planar portion can be eliminated such that the tapered portion 106*b* extends to the central axis of the pallet deck 102.

Figure 9:
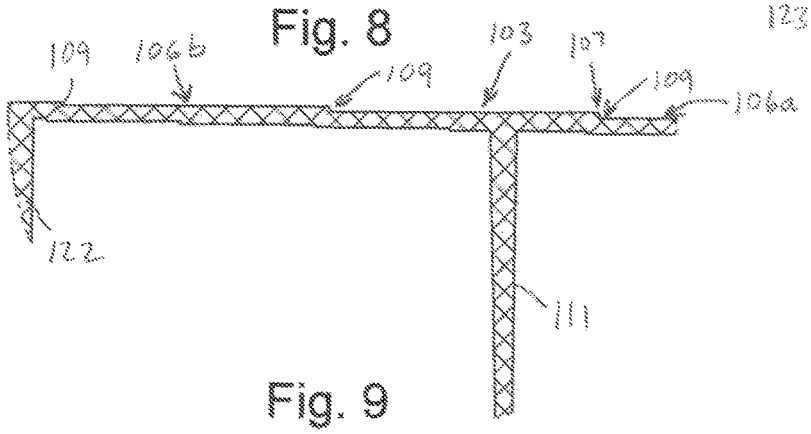
FIG. 9 is an expanded view of a portion of the pallet as indicated by the circle in FIG. 8.

Referring to FIGS. 4 and 9, in the present embodiment, the taper from the outer perimeter 105 to the inner perimeter 107 of the tapered portion 106*b* is achieved by a plurality of steps 109 defined in the deck surface 103. Each step 109 incrementally lowers the height of the deck surface 103 relative to the base plane P to achieve the tapered configuration. As illustrated in FIG. 4, the steps 109 may be staggered in the lateral and longitudinal directions. In the present embodiment, the tapered deck surface 103 defines the concave load support surface.

Figure 10:
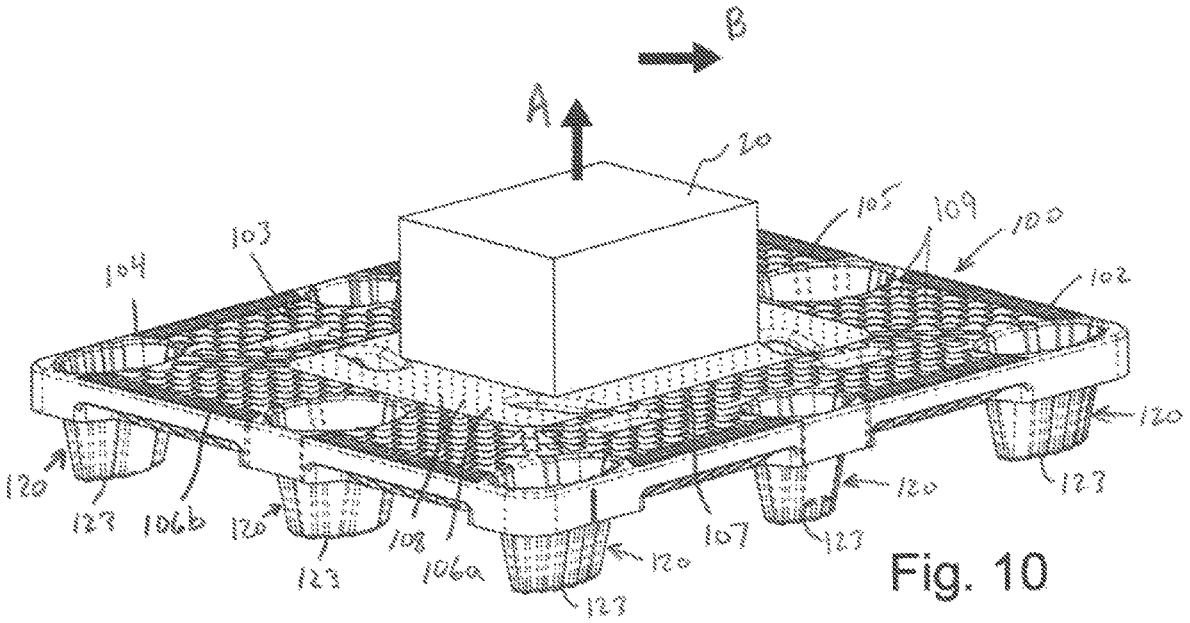
FIG. 10 is a perspective view of the pallet of FIG. 2 with a box positioned thereon and illustrating the forces necessary to move the box off of the pallet.
Figure 11:
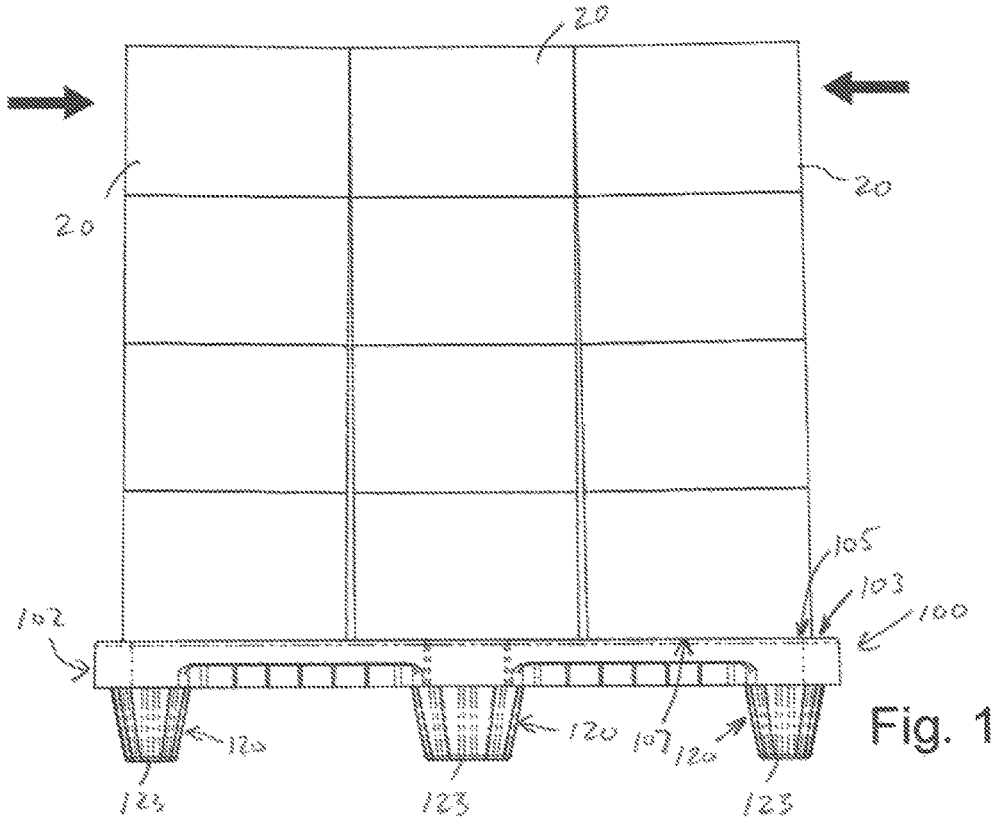
FIG. 11 is a side elevation view of the pallet of FIG. 2 with columns of boxes positioned thereon and illustrating the forces applied thereon by the concave top deck.
Figure 12:
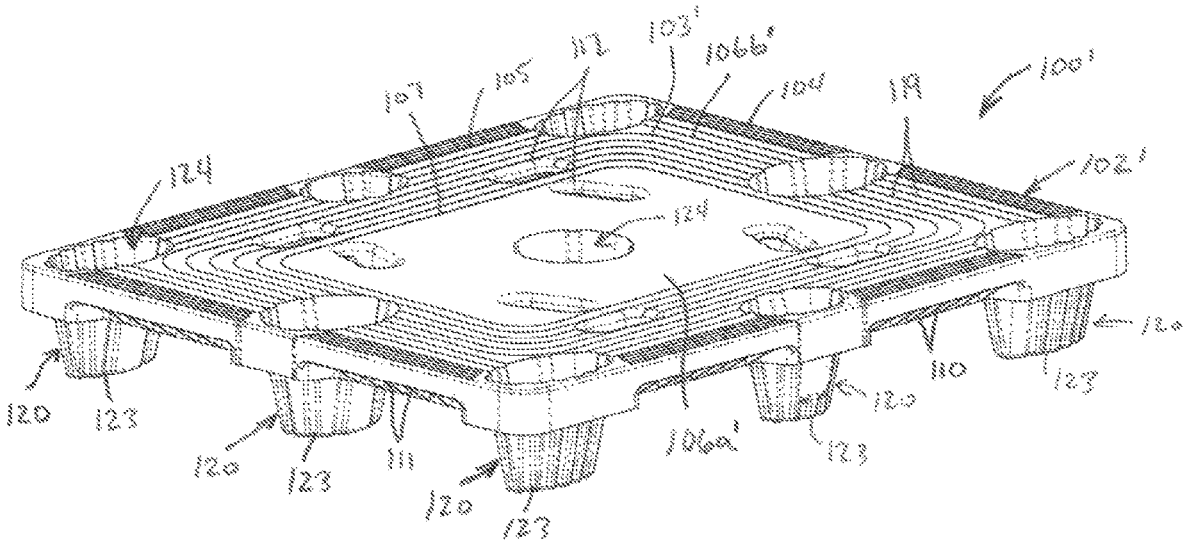
FIG. 12 is a perspective view of a pallet in accordance with another embodiment of the invention.
Figure 13:
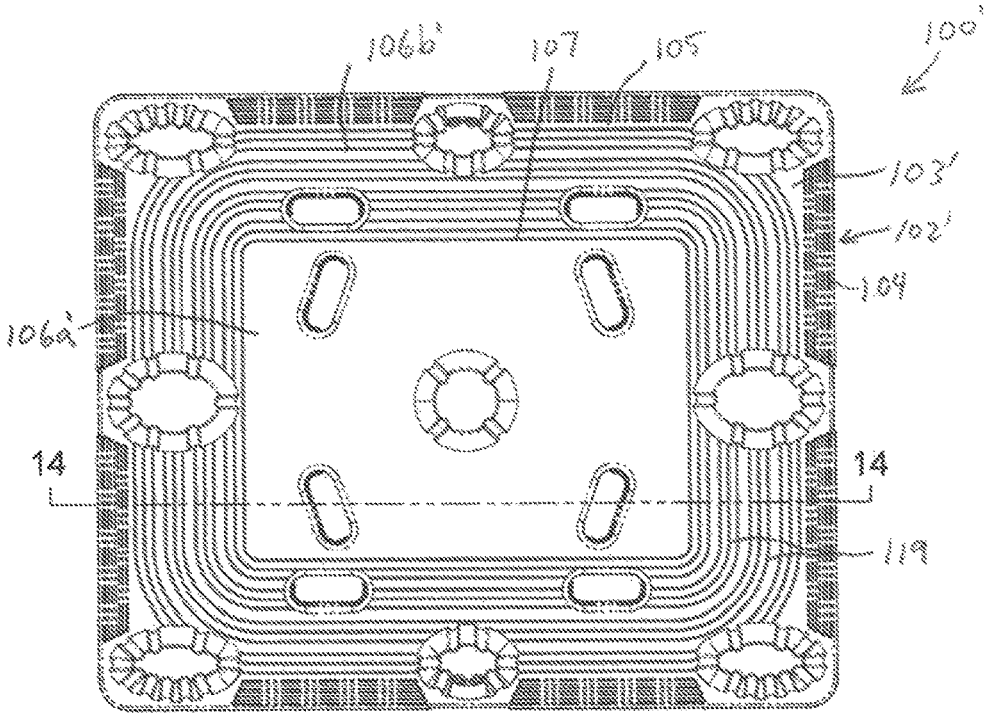
FIG. 13 is top plan view of the pallet of FIG. 12.
Figure 14:
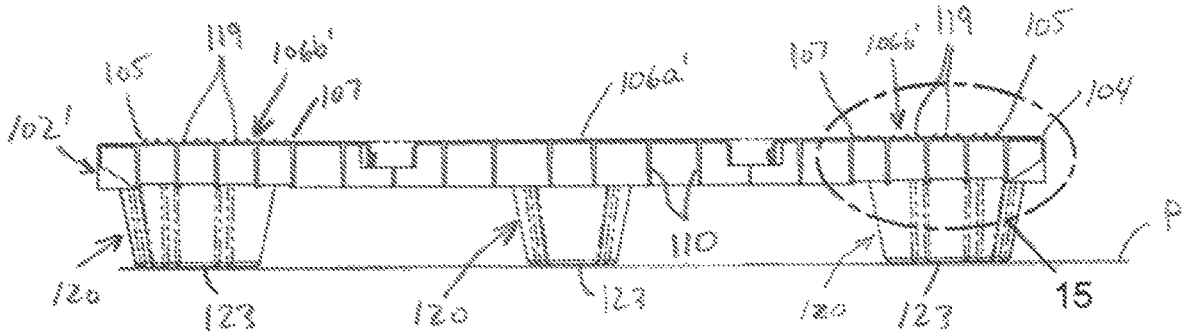
FIG. 14 is a cross-sectional view along the line 14-14 in FIG. 13.
Figure 15:
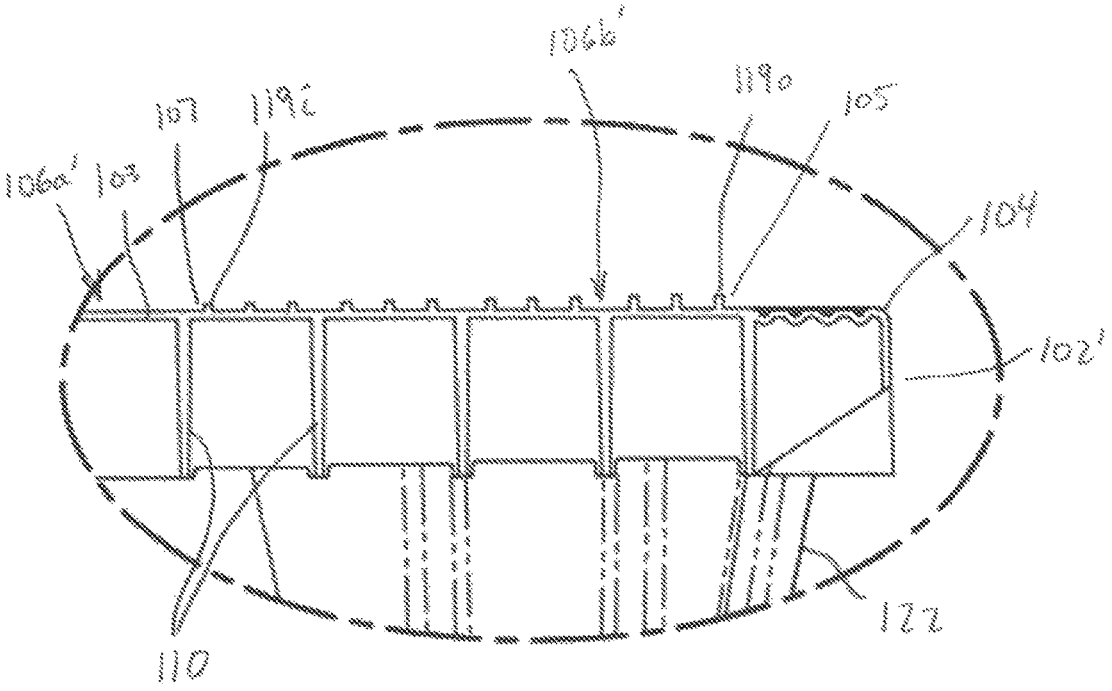
FIG. 15 is an expanded view of a portion of the pallet as indicated by the circle in FIG. 14.
Figure 16:
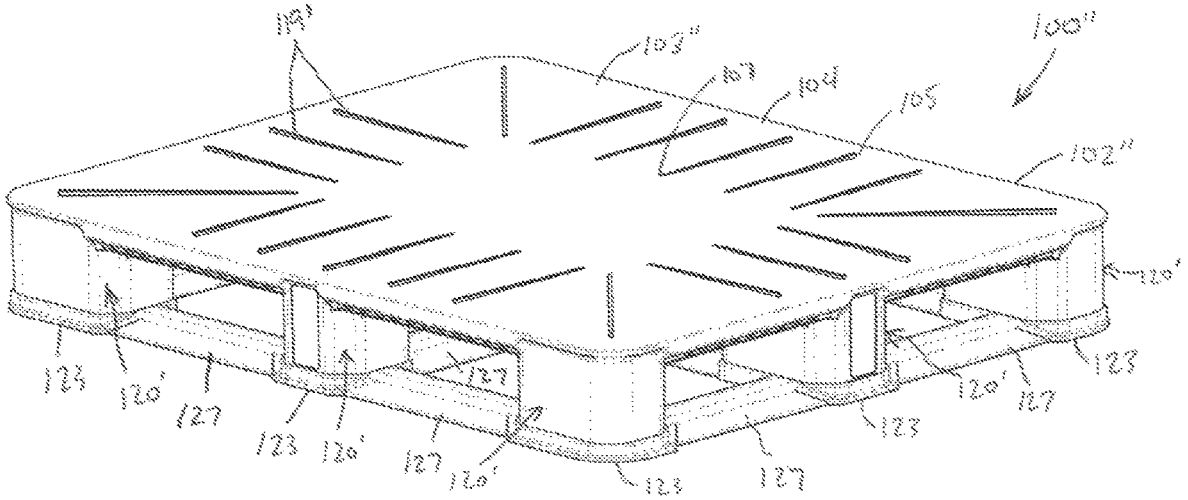
FIG. 16 is a perspective view of a pallet in accordance with another embodiment of the invention.
Figure 17:
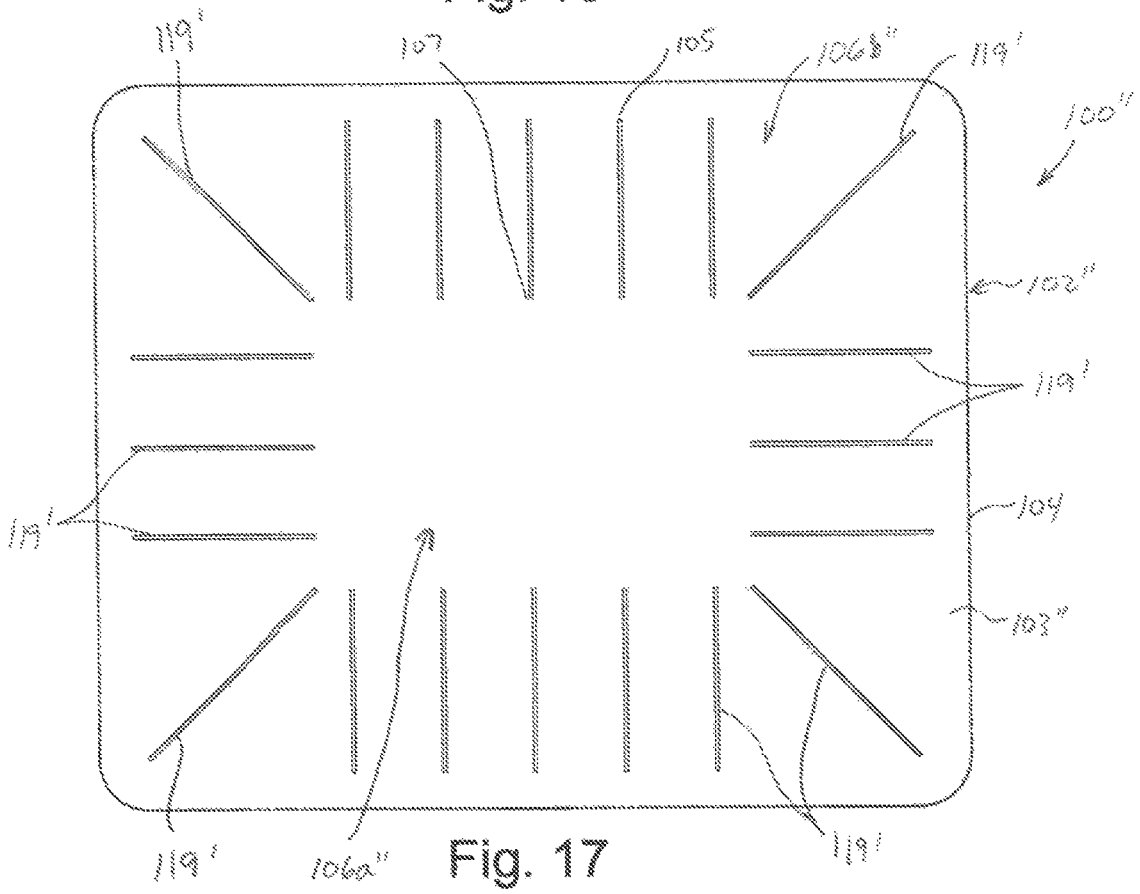
FIG. 17 is top plan view of the pallet of FIG. 16.
Figure 18:
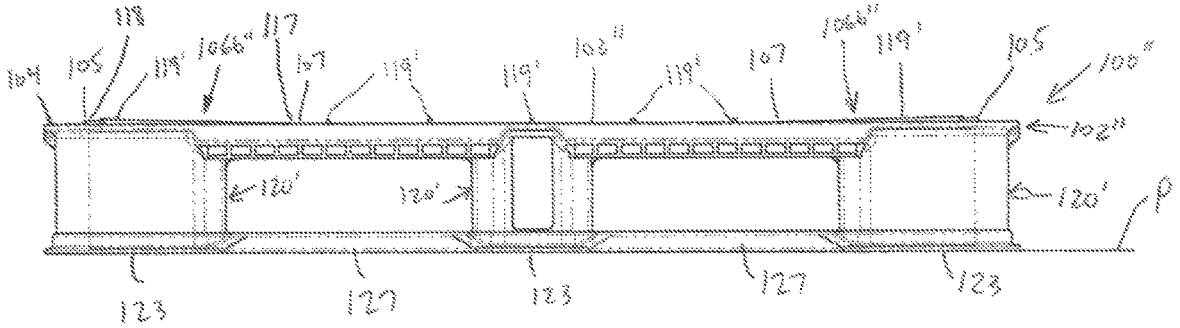
FIG. 18 is a front elevation view of the pallet of FIG. 16.
Figure 19:
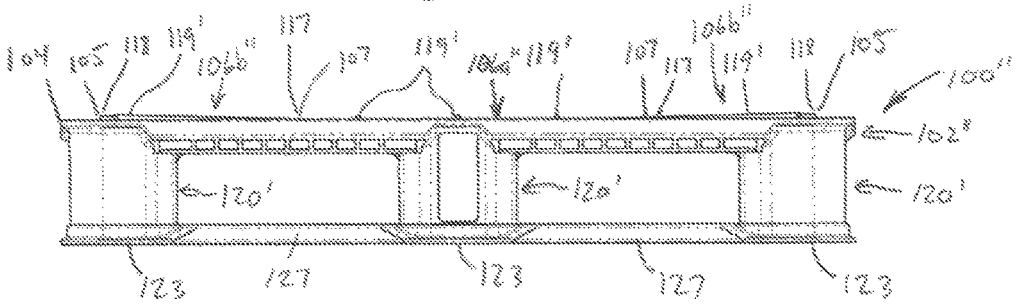
FIG. 19 is a side elevation view of the pallet of FIG. 16.

Referring to FIGS. 10 and 11, the effects of the concave load support surface are illustrated. As illustrated in FIG. 10, in order for the box 20 to become displaced, it must be subject to the energy to elevate its mass out of the concave depression, arrow A, and also the energy to overcome the frictional characteristics between itself and the deck surface 103, arrow B. This results in more stability of the load on the load support surface defined by the pallet deck surface 103.

Referring to FIG. 11, the concave load support surface defined by the deck surface 103 also helps to stabilize boxes 20 which are stacked in columns. The concave load support surface positions the bottom boxes of the outer columns with a slight inclination toward the center of the load. As the subsequent boxes are stacked on each column, the inward lean is maintained. When the load is complete, the component boxes and columns are disposed toward each other, as indicated by arrows C, rather than in a neutral position, or away from each other. This creates a more stable load.

Further, as the pallet deck 102 bows, the center of gravity of the columns is toward the center of the pallet. A much greater bow of the pallet is required to force the center of gravity of the column to move outward to a position above the balance point of the column and finally outside of the point where the column would become unstable. The inclined portions of the concave pallet deck surface 103 will resist these conditions by creating a proclivity for the load to move toward the center of the pallet.

Additionally, the inclined surfaces of the present invention serve to move the center of gravity of a column of boxes toward the center of the pallet. This predisposition of the center of gravity toward the center of the pallet necessitates a greater movement of the stack to render it unstable. In other words, a load on a concave pallet surface can resist greater centrifugal and lateral forces without becoming unstable than can an identical load on a planar pallet surface.

Additionally, the increased height of the pallet 100 toward the perimeter creates a stiffer pallet deck 102. In a simplistic form, a loaded pallet can be represented as a beam with a uniformly distributed load. The moment of inertia (I) is a measure of such a beam's stiffness with respect to its cross section and its ability to resist bending. As I increases, bending decreases and as I decreases bending increases. For the example of a pallet modeled as a simplified beam, the calculation of I for a solid rectangular cross section will be $I=bH^3/12$ where b is the base width and H is the height of the cross section. As such, the increased height toward the perimeter will increase the value for I, thereby decreasing bending, or in this case, the pallet becomes stiffer. This method of increasing stiffness also provides a significant increase in stiffness without adding material to the center of the deck which would increase raw material costs.

Referring to FIGS. 12-15, a pallet 100' in accordance with another embodiment of the invention will be described. The pallet 100' is similar to the previous embodiment and only the differences will be described herein. The pallet 100' includes a pallet deck 102' supported by a plurality of legs 120. In the present embodiment, the pallet deck 102' does not include grommet sockets, but such could be provided.

The pallet deck 102' includes a deck surface 103' supported by a plurality of ribs 110, 111, with a central planar portion 106*a*' and a perimeter tapered portion 106*b*'. In the present embodiment, the central planar portion 106*a*' is illustrated as a smooth surface, but may include bumps or the like to provide an anti-slip surface. The perimeter tapered portion 106*b*' extends from an outer perimeter 105 to an inner perimeter 107, however, the taper is not defined by a tapering of the deck surface 103' as the deck surface 103' extends generally parallel to the base plane P. In the present embodiment, the taper is defined by a plurality of annular ribs 119 extending upward from the deck surface 103', with the annular ribs 119 increasing in height from an inner most rib 119*i* proximate the inner perimeter 107 to an outermost rib 1190 proximate the outer perimeter 105. With this configuration, the load support surface is defined by the deck surface 103' in the central planar portion 106*a*' and by the top surfaces of the annular ribs 119 in the tapered portion 106*b*'. Again, the load support surface defines a concave surface which functions in a similar manner to that described above with respect to the first embodiment.

Referring to FIGS. 16-19, a pallet 100" in accordance with another embodiment of the invention will be described. The pallet 100" is similar to the previous embodiments and only the differences will be described herein. The pallet 100" includes a pallet deck 102" supported by a plurality of legs 120'. In the present embodiment, the legs 120' are not hollow, but are instead tubular structures enclosed at one end by the pallet deck 102" and at the other end by the bottom surfaces 123. Additionally, legs 120' are connected to one another by beams 127 extending along the base plane P. In the present embodiment, the pallet deck 102" does not include hand holes or grommet sockets, but such could be provided.

The pallet deck 102" includes a deck surface 103" supported by a plurality of ribs with a central planar portion 106*a*" and a perimeter tapered portion 106*b*". In the present embodiment, the central planar portion 106*a*" is illustrated as a smooth surface, but may include bumps or the like to provide an anti-slip surface. The perimeter tapered portion 106*b*" extends from an outer perimeter 105 to an inner perimeter 107, however, the taper is not defined by a tapering of the deck surface 103" as the deck surface 103" extends generally parallel to the base plane P. In the present embodiment, the taper is defined by a plurality of radial ribs 119' extending upward from the deck surface 103". Each radial rib 119', increases in height from an inner most portion thereof 117 proximate the inner perimeter 107 to an outermost portion thereof 118 proximate the outer perimeter 105. With this configuration, the load support surface is defined by the deck surface 103" in the central planar portion 106*a*" and by the top surfaces of the radial ribs 119' in the tapered portion 106*b*". Again, the load support surface defines a concave surface which functions in a similar manner to that described above with respect to the first embodiment.

Figure 20:
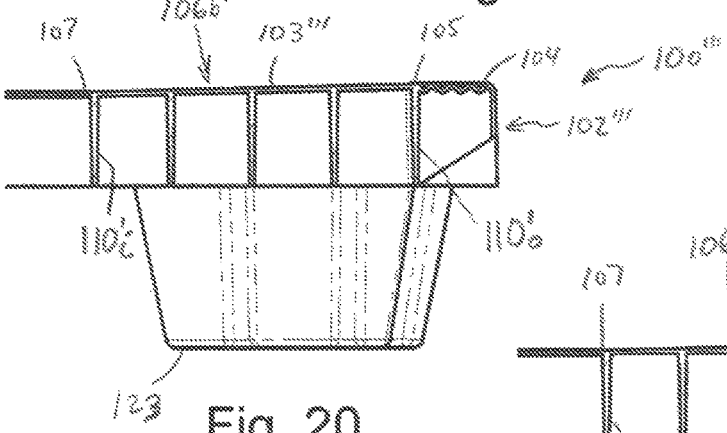
FIG. 20 is a cross-sectional view of a portion of a pallet in accordance with another embodiment of the invention.
Figure 21:
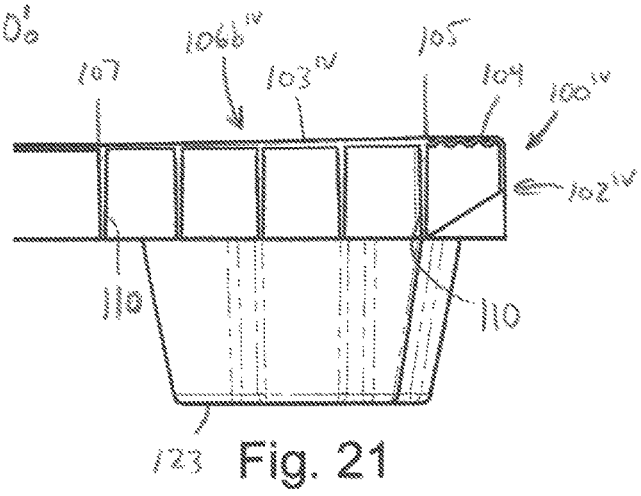
FIG. 21 is a cross-sectional view of a portion of a pallet in accordance with another embodiment of the invention.

FIGS. 20 and 21 illustrate additional manners of defining the tapered portion of the load support surface. In the embodiment of the pallet 100'" illustrated in FIG. 20, the pallet deck 102'" includes a deck surface 103'" that tapers from the inner perimeter 107 of the tapered portion 106*b*'" to the outer perimeter 105 thereof. To support the tapering surface 103'", the lateral and longitundinal ribs (only lateral ribs 110' illustrated) increase in height from an inner most rib 110'*i* proximate the inner perimeter 107 to an outer most rib 110'*o* proximate the outer perimeter 105. In the embodiment of the pallet 100$^{iv}$ illustrated in FIG. 21, the pallet deck 102$^{iv}$ includes a deck surface 103$^{iv}$ that tapers from the inner perimeter 107 of the tapered portion 106*b*$^{iv}$ to the outer perimeter 105 thereof. The taper is defined by increasing the thickness of the deck surface 103$^{iv}$ moving from the inner perimeter 107 to the outer perimeter 105. In both embodiments, the load support surface is defined directly by the pallet deck surface 103'", 103$^{iv}$ and the load support surface defines a concave surface which functions in a similar manner to that described above with respect to the first embodiment.

Figure 22:
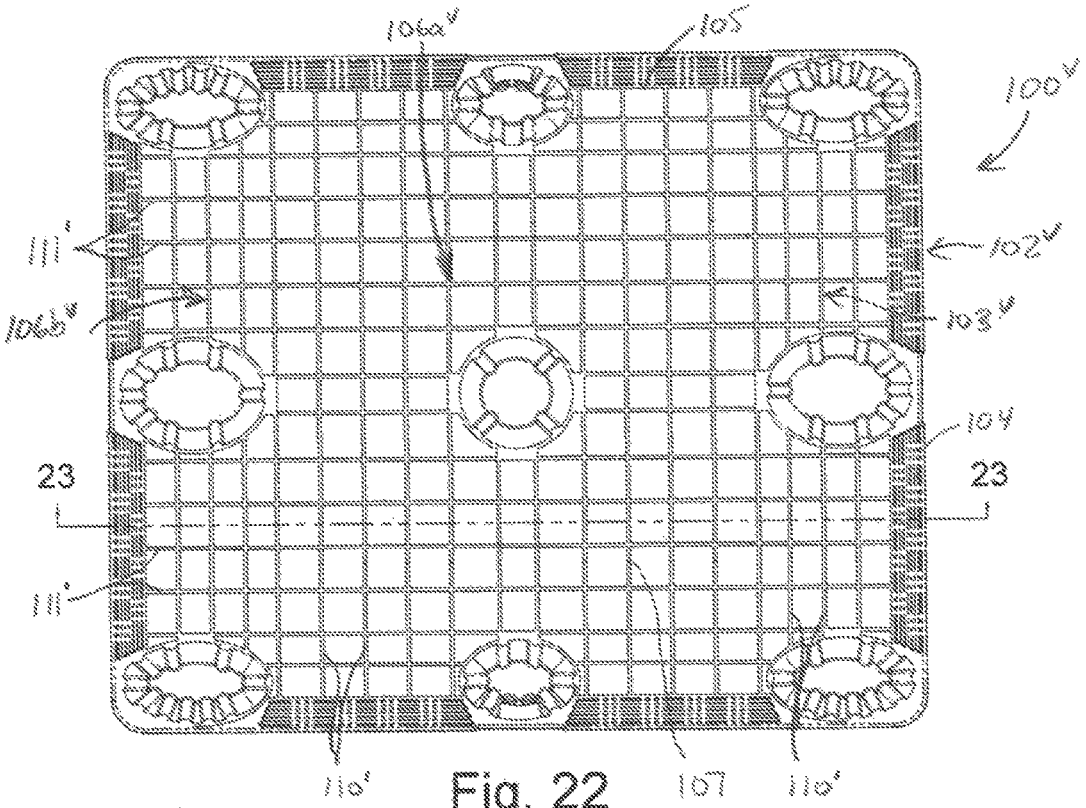
FIG. 22 is a top plan view of a pallet in accordance with another embodiment of the invention.
Figure 23:
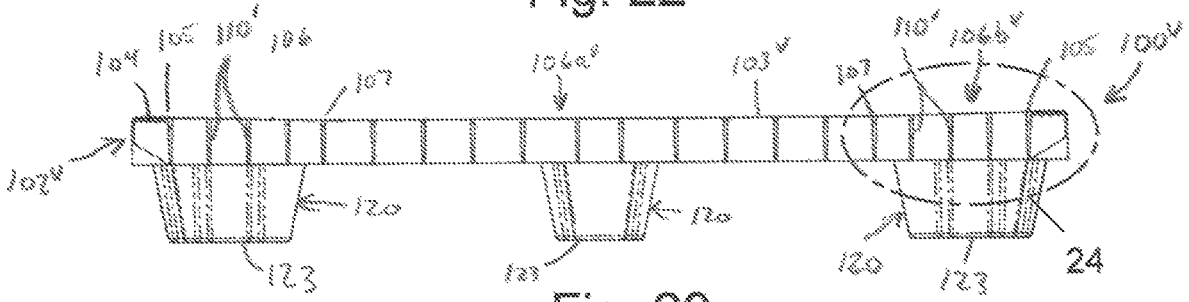
FIG. 23 is a cross-sectional view along the line 23-23 in FIG. 22.
Figure 24:
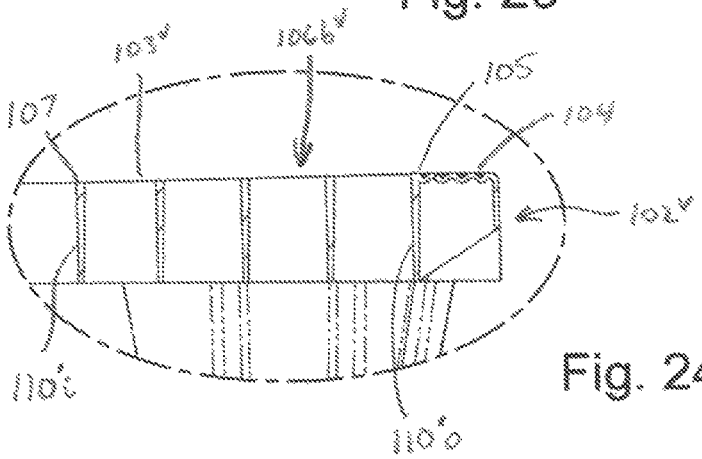
FIG. 24 is an expanded view of a portion of the pallet as indicated by the circle in FIG. 23.
Figure 25:
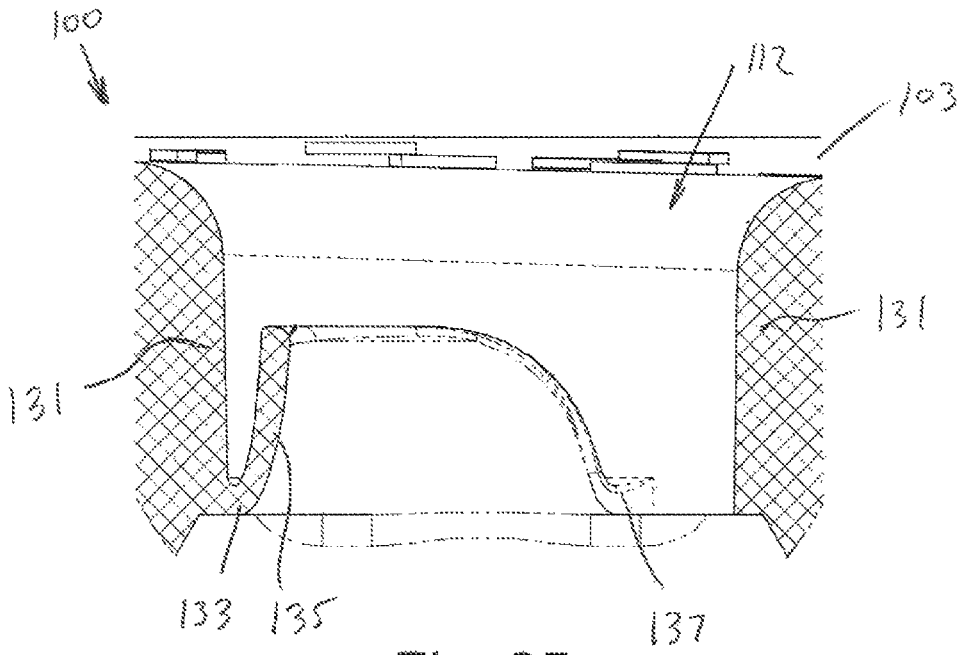
FIG. 25 is a cross-sectional view along the line 25-25 in FIG. 4.

Referring to FIGS. 22-24, a pallet 100*w* in accordance with another embodiment of the invention will be described. The pallet 100*w* is similar to the previous embodiments and only the differences will be described herein. In the present embodiment, the pallet deck 102$^{v}$ does not include a deck surface but instead the load support surface is defined by the top surface of the lateral and longitudinal ribs 110', 111' and has an open configuration. Each of the ribs 110', 111' has a constant central height to define the central planar portion 106*a*$^{v}$ and tapers from a lower most height 110'*i* proximate the inner perimeter 107 to a higher height 110'*o* proximate the outer perimeter 105 to define the perimeter tapered portion 106*b*$^{v}$.

With this configuration, the load support surface is defined by the tops of the ribs 110', 111' in both the central planar portion 106*a*" and by the top surfaces of the ribs 110', 111' in the tapered portion 106*b*". Again, the load support surface defines a concave surface which functions in a similar manner to that described above with respect to the first embodiment.

While various configurations are described above separately to define the load support surface having a concave configuration, it is understood that more than one of the configurations may be combined in a pallet deck in accordance with the invention.

While each of the embodiments described above include legs extending from the pallet deck and defining the base plane, it is understood that the present invention may be utilized with a deck board or slave board, used for example on a conveyor or a truck with a multi-level system for loading product. In such applications, the bottom surface of the pallet deck defines the base plane. Any of the above described configurations can be utilized to define the load support surface having a concave configuration on such a deck board or slave board.

These and other advantages of the present invention will be apparent to those skilled in the art from the foregoing specification. Accordingly, it will be recognized by those skilled in the art that changes or modifications may be made to the above-described embodiments without departing from the broad inventive concepts of the invention. It should therefore be understood that this invention is not limited to the particular embodiments described herein, but is intended to include all changes and modifications that are within the scope and spirit of the invention as defined in the claims.

What is claimed is:

1. A pallet comprising:

a pallet deck supported along a base plane;

wherein the pallet deck defines a load support surface within a given perimeter and at least one hand hole extending through the pallet deck, the at least one hand hole defined by a circumferential wall extending below the load support surface, the circumferential wall having a lower edge with a curved surface defined along at least a portion of the lower edge of the circumferential wall, and wherein the curved surface is defined by a return wall extending within the circumferential wall.

2. The pallet according to claim 1 wherein the curved surface extends along a portion of the lower edge of the circumferential wall facing toward the given perimeter.

3. The pallet according to claim 1 wherein the curved surface extends along more than 50% of the lower edge of the circumferential wall.

4. The pallet according to claim 1 wherein the remainder of the lower edge of the circumferential wall which does not include a curved surface has a flat configuration.

5. The pallet according to claim 1 wherein the load support surface includes at least a tapered portion which tapers in increasing height relative to the base plane from a tapered portion inner perimeter to a tapered portion outer perimeter such that the load support surface has a concave configuration.

6. The pallet according to claim 5 wherein the at least one hand hole is defined through the tapered portion.

7. The pallet according to claim 5 wherein the load support surface includes a central planar portion within the tapered portion inner perimeter, the central planar portion extending substantially parallel to the base plane.

8. The pallet according to claim 7 wherein the at least one hand hole is defined through the central planar portion.

9. The pallet according to claim 7 wherein at least one hand hole is defined through the central planar portion and at least one hand hole is defined through the tapered portion.

10. The pallet according to claim 1 wherein the circumferential wall is supported by a plurality of reinforcing ribs.

11. The pallet according to claim 1 further comprising a plurality of legs, each leg defining a bottom surface with the bottom surface of each of the legs extending in the base plane.

12. The pallet according to claim 11 wherein each leg includes a perimeter wall and a bottom surface about an open hollow area such that the legs are nestable.

13. The pallet according to claim 1 wherein the pallet deck defines at least one grommet socket.

14. The pallet according to claim 1 wherein the pallet deck defines at least one anchor slot.

* * * * *